US006126292A

United States Patent [19]

Liu

[11] Patent Number: 6,126,292

[45] Date of Patent: Oct. 3, 2000

[54] RICE FLAIL ASSEMBLY

[76] Inventor: Kuo-Hsin Liu, 1st Fl., No. 95, Sec. 2, Liming Rd., Nantun Dist., Taichung, Taiwan

[21] Appl. No.: 09/088,983

[22] Filed: Jun. 2, 1998

[51] Int. Cl.[7] ..... A45B 3/02; A63B 15/02

[52] U.S. Cl. ..... 362/102; 362/109; 362/234; 362/253; 463/47.5; 463/47.4

[58] Field of Search ..... 362/109, 102, 362/119, 120, 234, 253; 273/84; 272/75; 463/47.4, 47.5; 231/7

[56] References Cited

U.S. PATENT DOCUMENTS 3,937,468 2/1976 Conde, Sr. ..... 273/84

4,023,803 5/1977 Lewis ..... 273/84

5,547,190 8/1996 Mackewich, Jr. et al. ..... 273/84

*Primary Examiner*—Alan Cariaso

*Assistant Examiner*—Ali Alavi

*Attorney, Agent, or Firm*—Jackson Walker L.L.P.

[57] ABSTRACT

A rice flail assembly includes a pair of transparent rods each having one end portion having an end face, a pair of sleeves each mounted on one of the corresponding rods, a pair of connecting posts each received in one of the corresponding sleeves and connected with a connecting chain, and a pair of light emitting devices each mounted in one of the corresponding sleeves and each pressed between the connecting post and the end face of the rod for emitting light, thereby creating an aesthetic quality and enhancing the amusing effect thereof.

1 Claim, 3 Drawing Sheets

RICE FLAIL ASSEMBLY

FIELD OF THE INVENTION

The present invention relates to a rice flail assembly.

BACKGROUND OF THE INVENTION

A conventional rice flail includes two rods and a connecting chain having two end portions each pivotally connecting with one of the corresponding rods. The rice flail is usually used as a defensive weapon but can also be used for an amusing performance. By such an arrangement, however, it is often tedious during the swaying or swinging operation of the rice flail because of the lack of variety, thereby limiting the versatility of the rice flail.

The present invention has arisen to mitigate and/or obviate the disadvantage of the conventional rice flail.

SUMMARY OF THE INVENTION

In accordance with one aspect of the present invention, there is provided a rice flail assembly comprising a pair of transparent rods each including a first end portion having an end face and a second end portion, a pair of sleeves each fixedly mounted on the first end portion of one of the corresponding rods and each including a top edge defining a hole, a pair of connecting posts each including a first end portion slidably extending through the hole of one of the corresponding sleeves and a second end portion received in the sleeve, a connecting chain including two end portions each connected with the first end portion of one of the corresponding connecting posts, and a pair of light emitting devices each mounted in one of the corresponding sleeves.

Each of the light emitting devices comprises a battery slidably received in the sleeve and including a first side abutting on the second end portion of one of the corresponding connecting posts and a second side, a circuit board fixedly mounted on the second side of the battery to move therewith, a light emitting component fixedly mounted on the circuit board, and a push button switch fixedly mounted on the circuit board to move therewith and movable between a first position where the push button switch is in contact with the top edge of the first end portion of one of the corresponding rods, thereby electrically connecting the battery with the light emitting component via the circuit board such that the light emitting component lights, and a second position where the push button switch is detached from the end face of the first end portion of the rod.

Further features of the present invention will become apparent after a careful reading of the detailed description with appropriate reference to the accompanying drawings.

DETAILED DESCRIPTION OF THE PREFERRED EMBODIMENTS

Figure 1:
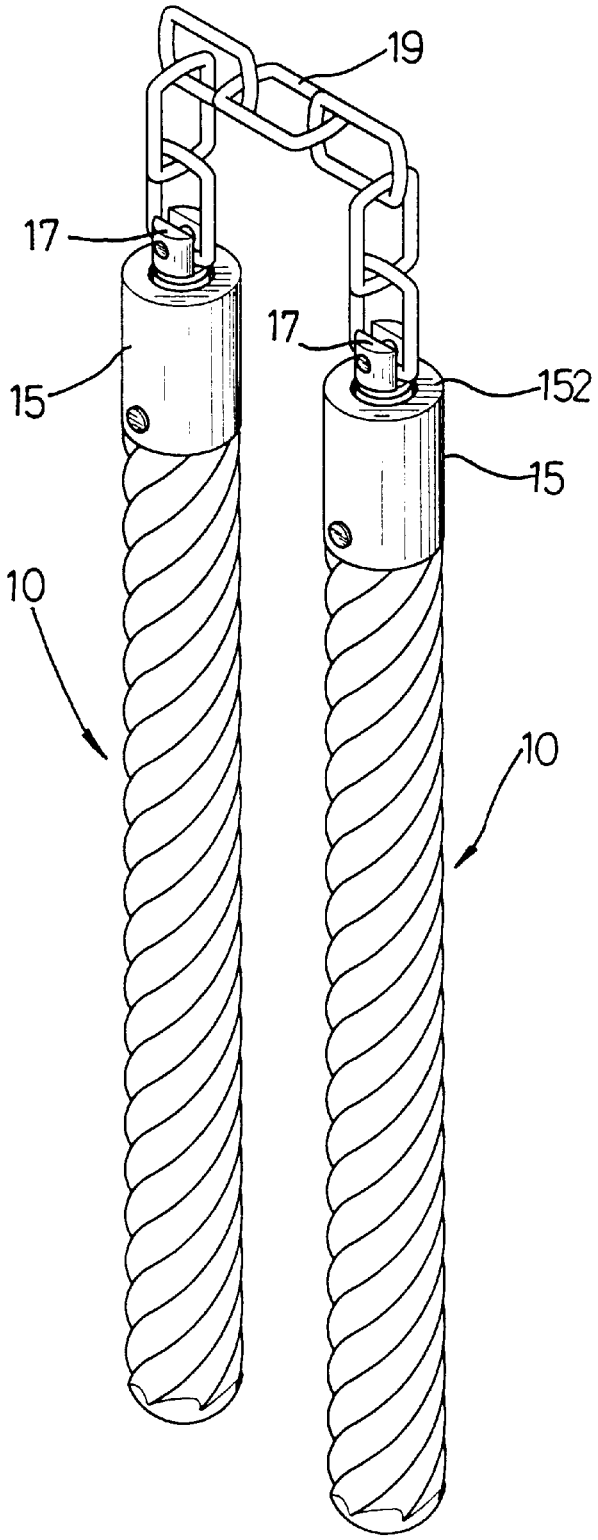
FIG. 1 is a perspective view of a rice flail assembly in accordance with the present invention.
Figure 2:
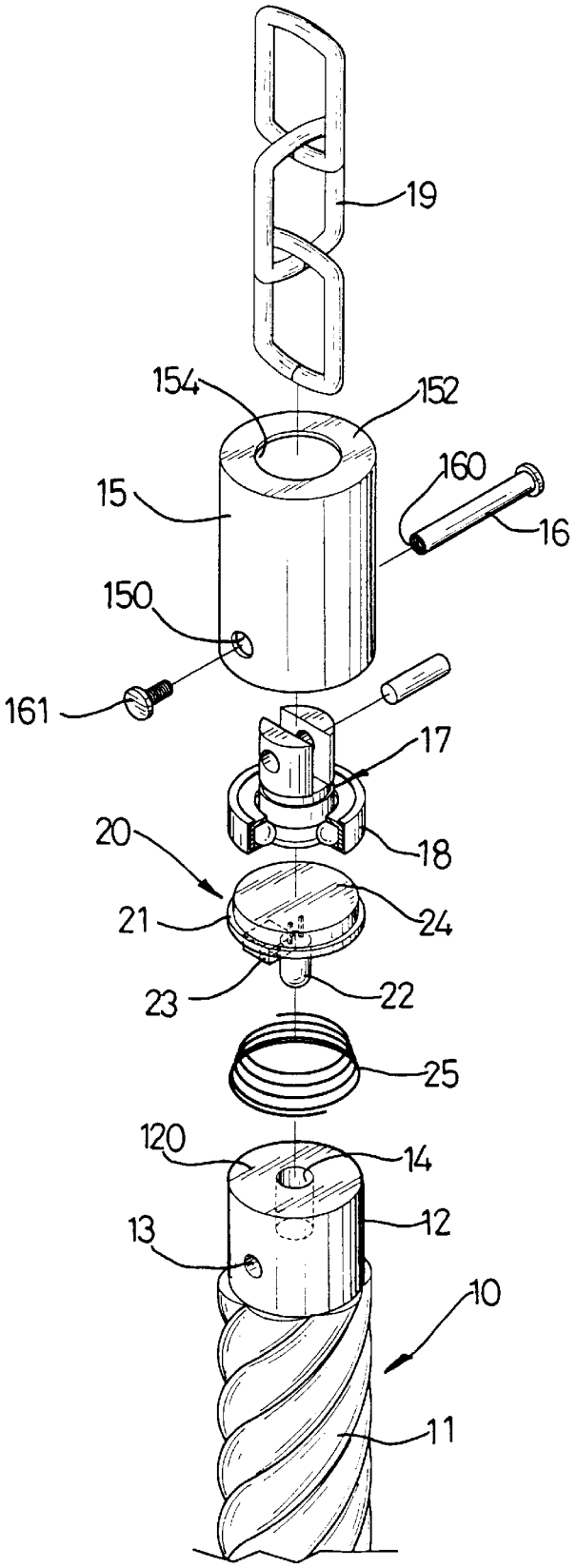
FIG. 2 is a partially cut-away exploded view of the rice flail assembly as shown in FIG. 1.
Figure 3:
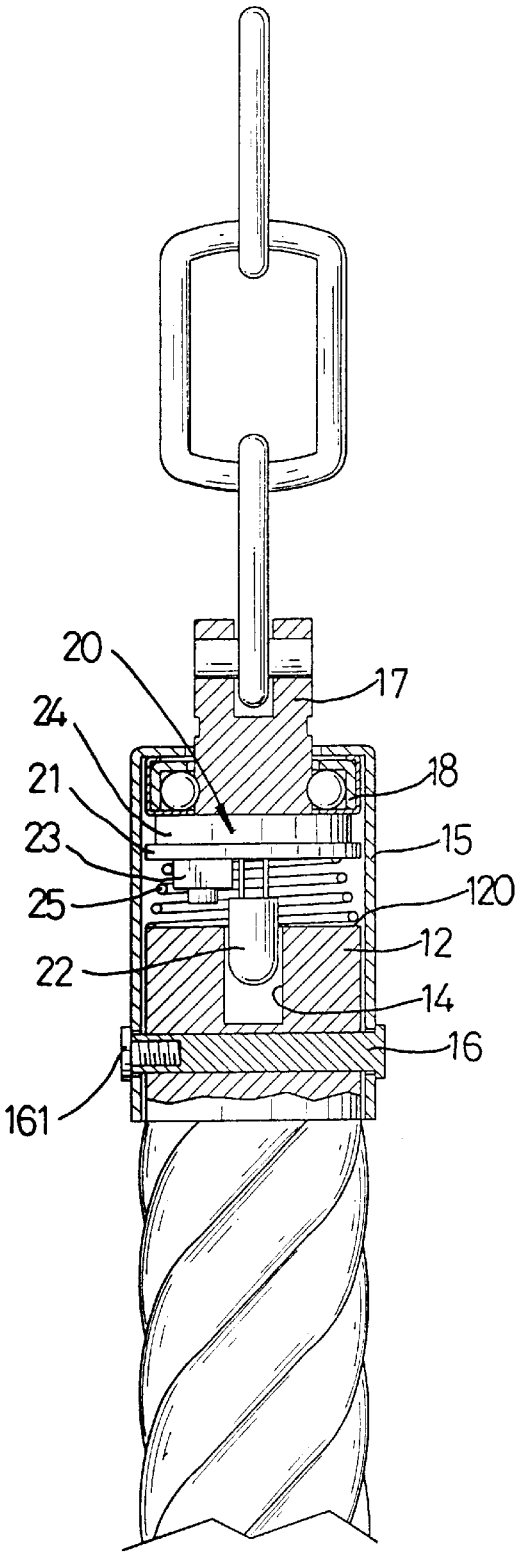
FIG. 3 is a front plan partially cross-sectional view of the rice flail assembly as shown in FIG. 1.

Referring to the drawings and initially to FIGS. 1–3, a rice flail assembly in accordance with the present invention comprises a pair of transparent rods 10 each including a first end portion 12 having an end face 120 and a second end portion. Each of the two transparent rods 10 includes an outer periphery formed with a helical corrugated pattern 11.

A pair of tubular sleeves 15 are each fixedly mounted on the first end portion 12 of one of the corresponding rods 10 and each includes a top edge 152 defining a hole 154. Each of the sleeves 15 includes a first transverse bore 150, the first end portion 12 of each of the rods 10 includes a second transverse bore 13 aligning with the first bore 150, a pair of positioning pins 16 each extend through the first bore 150 and the second bore 13 and each contain a threaded bore 160, and two positioning screws 161 are each threaded into the threaded bore 160 of one of the corresponding positioning pins 16, thereby fixing each of the sleeves 15 on the first end portion 12 of the respective rod 10.

A pair of connecting posts 17 each include a first end portion slidably extending through the through hole 154 of one of the corresponding sleeves 15 and a second end portion received in the sleeve 15. Two bearings 18 are each rotatably mounted around one of the two corresponding connecting posts 17 and are each received in one of the corresponding sleeves 15. A connecting chain 19 includes two end portions each connected with the first end portion of one of the corresponding connecting posts 17. The first end portion of each connecting post 17 includes two side portions separated by a longitudinal slot with a closed bottom and an open top. A transverse bore extends through the side portions and communicates with the longitudinal slot. Each transverse slot of the connecting posts 17 snugly receives therein one of two dowels after a respective end link of the connecting chain 19 has been engaged around the respective dowel.

A pair of light emitting devices 20 are each mounted in one of the corresponding sleeves 15 and each comprise a battery 24 slidably received in the sleeve 15 and including a first side abutting on the second end portion of one of the corresponding connecting posts 17 and a second side, a circuit board 21 fixedly mounted on the second side of the battery 24 to move therewith, a light emitting component 22 fixedly mounted on the circuit board 21, a push button switch 23 fixedly mounted on the circuit board 21 to move therewith, and a biasing member 25 mounted between the circuit board 21 and the end face 120 of the first end portion 12 of the rod 10. The push button switch 23 is conventional and will not be described in detail hereinafter other than that it can be switched from a first position to at least one other position.

The first end portion 12 of each of the rods 10 defines a receiving space 14 for receiving the light emitting component 22 of one of the two corresponding light emitting devices 20 therein.

Figure 4:
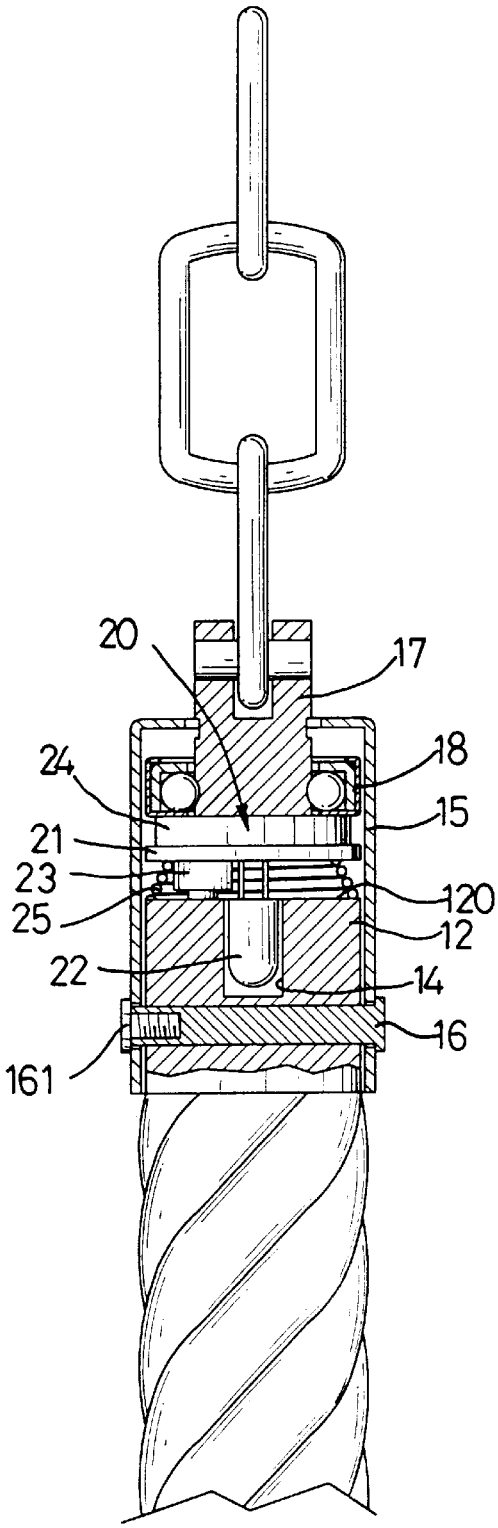
FIG. 4 is an operational view of FIG. 3.

In operation, referring to FIGS. 3 and 4 with reference to FIGS. 1 and 2, each of the connecting posts 17 can be pressed inwardly toward the respective rod 10 so as to move the battery 24 together with the circuit board 21 in the respective sleeve 15 such that the push button switch 23 can be displaced from an 'off' first position as shown in FIG. 3 where the push button switch 23 is separate from the end face 120 of the first end portion 12 of the rod 10, to a second position as shown in FIG. 4 where the push button switch 23 is in contact with and pressed by the end face 120 of the first end portion 12 of one of the corresponding rods 10, thereby electrically connecting the battery 24 with the light emitting component 22 via the circuit board 21 such that the light or the switch 23 can be pressed again to a third mode wherein the light emitting component 22 lights or flashes, thereby creating an aesthetic quality and enhancing the amusing effect of the rice flail assembly.

The push button switch 23 can then be returned from the operation position as shown in FIG. 4 to its initial position as shown in FIG. 3 by means of the returning force of the biasing member 25 so as, to be detached from the end face 120 of the first end portion 12 of the rod 10 such that the light emitting component 22 lights or flashes continuously.

The above-mentioned procedures can be performed again such that the push button switch 23 can be moved to be in contact with and pressed by the end face 120 of the first end portion 12 of the respective rod 10 again, thereby shutting off the light emitting component.

It should be clear to those skilled in the art that further embodiments may be made without departing from the scope and spirit of the present invention.

What is claimed is:

1. A rice flail assembly comprising:

a pair of transparent rods (10) each including a first end portion (12) having an end face (120) and a receiving space (14), a transverse bore (13), a second end portion, and an outer periphery formed with a helical corrugated pattern (11);

a pair of sleeves (15), each sleeve (15) fixedly mounted on said first end portion (12) of one of a corresponding said rods and each sleeve including a top edge (152) defining a hole (154) and a respective one of said rods (10) and including a top edge (152) defining a hole (154), and a bore (150) aligning with said transverse bore (13);

a pair of connecting posts (17), each post (17) including a first end portion slidably extending through said hole (154) of a respective one of said sleeves (15) and a second end portion received in said sleeve (15), said first end portion including linking means;

a connecting chain (19) including two end portions each pivotally connected with said linking means of said first end portion of a respective one of said connecting posts (17), wherein said linking means of each of said first end portions includes two side portions separated by a longitudinal slot with a closed bottom and an open top, a transverse bore extending through said side portions and in communication with said longitudinal slot, said transverse bore snugly receiving therein a dowel, whereby said two end portions of said connecting chain (19) are secured over a respective one of the dowels whereafter said dowel is inserted in said transverse bore;

two bearing posts (18) each rotatably mounted around a respective one of said two connecting posts (17) and each received in a respective one of said sleeves (15);

a pair of positioning pins (16) each extending through said bore (150) and said transverse bore (13) and each having a threaded bore (160), and two positioning screws (161) each threadedly received in said threaded bore (160) of a corresponding one of said positioning pins (16); and a pair of light emitting devices (20), each light emitting device (20) mounted in said receiving space (14) of a respective one of said sleeves (15), and comprising;

a battery (24) slidably received in said sleeve (15) and including a first side abutting said second end portion of a respective one of said connecting posts (17) and a second side;

a circuit board (21) fixedly mounted on said second side of said battery (24) to move therewith a light emitting component (22) mounted on the circuit board (21);

biasing means mounted between said circuit board (21) and said end face (120) of said first end portion of each of said rods (10); and a push button switch (23) fixedly mounted on said circuit board (21) to move therewith by said biasing means and movable between a first position where said push button switch (23) is in contact with said end face (120) of said first portion (12) of a respective one of said rods (10), thereby electrically connecting said battery (24) with said light emitting component (22) via said circuit board (21) such that said light emitting component (22) is activated, and a second position where said push button switch (23) is separate from said end face (120) of said first end portion (12) of said rod (10) such that said light emitting component is deactivated.

* * * * *